United States Patent [19]

Grüninger

[11] Patent Number: 4,648,911

[45] Date of Patent: Mar. 10, 1987

[54] SEALING PROCESS

[75] Inventor: Edgar Grüninger, Staad, Switzerland

[73] Assignee: FFA Flug-und Fahrzeugwerke AG, Switzerland

[21] Appl. No.: 610,996

[22] PCT Filed: Sep. 1, 1983

[86] PCT No.: PCT/CH83/00100

§ 371 Date: May 1, 1984

§ 102(e) Date: May 1, 1984

[87] PCT Pub. No.: WO84/00982

PCT Pub. Date: Mar. 15, 1984

[30] Foreign Application Priority Data

Sep. 3, 1982 [CH] Switzerland ..... 5258/82

[51] Int. Cl.[4] ..... C25D 11/24

[52] U.S. Cl. ..... 148/6.27; 204/37.6

[58] Field of Search ..... 148/6.27; 204/37.6

[56] References Cited

U.S. PATENT DOCUMENTS 2,927,872 3/1960 Cohn ..... 148/6.27

3,494,839 2/1970 Chambers ..... 204/35

4,045,599 8/1977 Remaley ..... 148/6.27

FOREIGN PATENT DOCUMENTS 0015856 6/1979 Japan ..... 204/37.6

6094155 12/1979 Japan ..... 148/6.27

OTHER PUBLICATIONS

Metal Finishing 12/1968.

*Primary Examiner*—Sam Silverberg

*Attorney, Agent, or Firm*—Webb, Burden, Robinson & Webb

[57] ABSTRACT

A novel seal process for sealing the surface of anodically oxidized metals in which an aqueous solution containing a first and second compound wherein the first compound is a nickel salt and the second compound is a fluoride is contacted onto the anodized surface, while the surface is still wet from the anodizing process, at a temperature below 30° C. The process is particularly suitable for use in the sealing of anodically oxidized aluminum surfaces, in addition to other anodically oxidized, colored or uncolored metal surfaces.

13 Claims, No Drawings

SEALING PROCESS

In the conventional anodic oxidation of metal surfaces, particularly surfaces of light metals, such as, for example, aluminum, by conversion of the top metal layers, protective layers of the corresponding metal oxide are formed. This results in fine-pore coatings which can be reacted with various reagents and/or colorants, which today make it possible to color, in particular, aluminum surfaces in a large number of shades. Dependng on the use of these products, known as anodized aluminum articles, for indoor or outdoor purposes, more or less weather-resistant surfaces are required. The large variety of colorants which are suitable for this purpose and their use are well known to one skilled in the art and do not require any further explanation here.

All anodic oxidation processes have in common that the resulting surfaces, regardless of whether they are colorless or have been colored in one of more stages, are sensitive to touch and to corrosive substances. In order to overcome this great disadvantage, various sealing processes have been developed, by which a touch-resistant and corrosion-resistant surface is obtained. The best known of these sealing processes comprises a treatment with boiling water of steam, and is known as hot water sealing or steam sealing process. These processes have a very high energy consumption. Another disadvantage of the hot water treatment is the formation of an undesirable deposit of lime and other salts and impurities dissolved in the bath water, it being necessary subsequently to remove this deposit mechanically in an additional operation. To prevent such deposits from forming, sealing additives have been proposed which are generally based on high molecular weight compounds but make the process more expensive because they have to be replenished.

Furthermore, metal salts, such as nickel salts, for example nickel acetate, have been proposed as additives for the hot water baths, in order to increase the sealing. These salt baths have a sealing effect at as low a temperature as 70° C. and therefore do not have to be used at the boiling point; in this case too, however, a very thick coating is formed which cannot be left on the surface.

Another disadvantage of the seal processes proposed hitherto is that the relatively high content of silicates, phosphates, chlorides and the like in the water is sufficient to act as a "seal poison", i.e. the resulting layers are of unsatisfactory quality and are very rapidly decomposed and completely corroded in the salt test.

Another difficulty in connection with the seal baths known hitherto is that they usually have a working life of about 3 to 6 weeks. After this time, they are useless and have to be discarded.

A novel seal process has now been developed which permits a treatment at temperatures below 30° C. and in particular at room temperature, does not result in contamination of the bath, does not require renewal of the bath but only replacement of the bath components removed by the material treated, and gives an outstanding sealing of the coatings.

Surprisingly, it has been found that these results can be achieved by treatment of the anodically oxidized, and if desired colored, metal surfaces, in particular aluminum surfaces, with an aqueous solution which contains a nickel salt and a fluoride.

The present invention therefore relates to a process for the sealing of anodically oxidized, uncolored or colored metal surfaces, in particular aluminium surfaces, which is characterized in that the still wet surface is treated at a temperature below 30° C. with an aqueous solution which contains at least one nickel salt and at least one fluoride.

Suitable nickel salts are inorganic nickel salts, such as nickel chloride, sulfate, carbonate, nitrate, etc., as well as organic nickel salts, such as nickel acetate and others. The fluoride is preferably a fluoride of an alkali metal salt, such as sodium fluoride, potassium fluoride, etc., or an ammonium fluoride, for example $(NH_4)HF_2$, or an organic fluoride.

The salts are preferably employed in approximately stoichiometric ratios of the nickel salt to the fluoride, the water of crystallization also having to be taken in account with the nickel salt. It is also possible to use larger or smaller amounts of the nickel salt or fluoride salt, but the results are generally poorer.

The optimum amount of salts added per liter of bath liquid depends on the particular surface to be treated, and can be determined by simple experiments. In general, the total salt addition (nickel salt and fluoride) amounts to about 1 to 20 g/liter, an amount of about 10 g/liter being preferred for aluminum surfaces.

The pH of the treatment solution is advantageously in the slightly acidic range, for example 5.5 to 5.8, and can be established with a conventional acid, for example acetic acid.

The treatment is carried out at a temperature below 30° C., preferably at room temperature, so that the energy consumption can be drastically reduced. The time for which the salt solution remains in contact with the metal surface is not critical. It is generally at least about 10 minutes. The treatment can be effected by immersion in a seal bath or by spraying, brushing on or any desired method. After the treatment, the treated surface is generally rinsed off with cold water, but this rinsing procedure can be dispensed with, without the quality of the surface being adversely affected.

Particularly when baths are used for the seal treatment, it is advisable to add a preservative, such as are also customary, for example, for dyeing baths and other electroplating baths, for example formalin, "Preventol" and others; in general it is sufficient to add 0.01 g/liter. If the preservative is not water-soluble, it can be dissolved in a water-miscible solvent, for example a lower aliphatic alcohol, such as methanol, ethanol, propanol, n- or iso-butanol, etc., and then added to the aqueous seal solution. An additive of this type may also be advisable for solutions for spraying on, brushing on, etc., if these solutions are stored open for a relatively long time, since they may readily be attacked by microorganisms.

The seal solutions can contain further conventional additives, such as wetting agents and the like.

It is important that the surfaces to be treated are subjected to the seal treatment according to the invention when they are still wet, i.e. virtually directly after the oxidation or coloring procedure, or after the final rinsing procedure. As soon as the oxide layer begins to dry, the process according to the invention no longer gives the desired sealing effect, even when the surface is wetted again. This is in contrast to the prior hot seal processes, in which it is still possible to seal the surface in the dry state, even after storage for a relatively long time.

The process according to the invention results in outstanding corrosion-resistance and a surface of smooth, pleasant appearance.

In the case of aluminum, for example, the sealing effect attains its maximum generally after 24 hours. The treated articles then have a permanent corrosion-resistance and are suitable for all conventional applications. No deposit or hydrate formation on the surfaces is observed in this process.

The corrosion rate (i.e. the loss in mass per unit area) for aluminum sheets determined by ISO 3210, which in the case of hot sealing is permitted to be up to 30 $mg/dm^2$ according to the Euras standard applicable today, is about 7 to 10 $mg/dm^2$ for sheets which are cold-sealed according to the invention. The corrosion rates obtained both for colorless anodized aluminum surfaces and in particular for aluminum surfaces colored, for example, by means of an electrolytic coloring procedure employing metal salt are substantially improved compared with those for hot-sealed surfaces (with or without added salt).

Apart from the considerable energy saving, the solution used according to the invention have the advantage that they cause substantially less environmental pollution than the solutions previously used, since their working life is virtually unlimited, and they therefore do not have to be discarded.

The present invention furthermore relates to a commercial agent for carrying out the above cold sealing process. This agent is characterized in that it contains at least one nickel salt and at least one fluoride of the type described above. The agent can be in the form of a dry mixture, a paste or a concentrate. It preferably contains the salts in an approximately stoichiometric ratio of nickel salt.$H_2O$ to fluoride. The agent can already contain further additives, such as wetting agents, preservatives, etc., but it is also possible to add these separately when preparing the solution. The agent can be kept for an unlimited time, and can be packed, for example, in a dosage form such that weighing, measuring or the like is not necessary when the solution is prepared or is replenished.

EXAMPLE 1

A bath is prepared by dissolving 10 g/liter of a mixture of 262.9 g of $Ni(SO_4).6H_2O$ and 42.0 g of NaF in water. 0.5 g/liter of the wetting agent "Ekalin F" (Sandoz) and 0.01 g/liter of "Preventol" (Bayer), dissolved in 10 g/liter of butanol, are added to this solution, and the pH of the solution is adjusted to 5.6 with acetic acid.

Aluminum profiles which have been subjected to colorless anodization in a conventional manner, and some of which have additionally been colored with "Colinal" 3175 (layer thickness 24$\mu$), were dipped, directly after leaving the final rising bath, into the above bath which was at a temperature of 25° C., and were left in this bath for 15 minutes. After 24 hours, the corrosion rate was 6.9 $mg/dm^2$ for the colorless surfaces, and 9.4 $mg/dm^2$ for the colored surfaces.

EXAMPLE 2

For comparison, identical profiles which had been subjected to colorless anodization and had a layer thickness of 24$\mu$ were subjected to the conventional hot sealing process and corrosion rates of 16.4 $mg/dm^2$ were obtained. Identical unsealed profiles which had been subjected to colorless anodization gave a corrosion rate of 14.4 $mg/dm^2$ after sealing as described in Example 1.

I claim:

1. A process for sealing the surface of anodically oxidized metals comprising contacting the anodized surface while the surface is still wet from the anodizing process at a temperature below 30° C. with an aqueous solution containing at least a first and second compound wherein said first compound is a nickel salt and said second compound is a fluoride and said nickel salt including its water of crystallization and said fluoride salt being present in approximate stoiciometrically equivalent amounts.

2. The process of claim 1, wherein the metal is aluminum.

3. The process of claim 1, wherein the fluoride is selected from the group consisting of an alkali metal fluoride, ammonium fluoride or a monovalent organic fluoride.

4. The process of claim 1, wherein the fluoride comprises at least one of sodium fluoride or potassium fluoride.

5. The process of claim 1, including adjusting the pH of the solution to the slightly acidic range.

6. The process of claim 5, wherein the pH adjustment is within the range of 5.5 to 5.8.

7. The process of claim 1, wherein the solution contains at least one of a preservative and wetting agent.

8. The process of claim 1, wherein the metal is color finished prior to sealing.

9. An agent for sealing the surface of anodically oxidized metals consisting essentially of an aqueous solution of at least a first and second compound wherein said first compound is a nickel salt and said second compound is a fluoride, said solution having a pH within the range of 5.5 to 5.8 and said nickel salt including its water of crystallization and said fluoride being present in approximately stoichiometrically equivalent amounts.

10. The agent of claim 9 wherein the fluoride is selected from the group consisting of an alkali metal fluoride, an ammonium fluoride and an organic fluoride.

11. The agent of claim 9, including at least one of a preservative and a wetting agent.

12. The agent of claim 9, wherein the salt and fluoride are present in amounts of 1 to 20 g/liter.

13. The agent of claim 10, said amount being about 10 g/liter.

* * * * *